US005364033A

United States Patent [19]

Cedoz et al.

[11] Patent Number: 5,364,033

[45] Date of Patent: Nov. 15, 1994

[54] SEAL FOR SPRAY GUN

[75] Inventors: Roger T. Cedoz, Curtice; John F. Schaupp, Toledo, both of Ohio

[73] Assignee: Ransburg Corporation, Indianapolis, Ind.

[21] Appl. No.: 87,489

[22] Filed: Jul. 6, 1993

[51] Int. Cl.[5] ..... B65D 53/02

[52] U.S. Cl. ..... 239/526; 277/118

[58] Field of Search ..... 239/527, 528, 526; 277/117, 118

[56] References Cited

U.S. PATENT DOCUMENTS

| | | | |
|---|---|---|---|
| 1,584,127 | 5/1926 | Norton | 277/117 X |
| 2,059,706 | 11/1936 | Paasche | 299/140 |
| 2,239,987 | 4/1941 | Bramsen et al. | 299/140 |
| 2,631,891 | 3/1953 | Kochner et al. | 299/89 |
| 2,657,098 | 10/1953 | Strahman | 299/131 |
| 2,864,649 | 12/1958 | Adams | 299/140.1 |
| 2,999,646 | 9/1961 | Wagner | 239/332 |
| 4,154,403 | 5/1978 | Forrester | 239/528 |
| 4,406,468 | 9/1983 | Gimple et al. | 277/115 |
| 4,560,109 | 12/1985 | Teruyuki et al. | 239/583 |
| 4,759,502 | 7/1988 | Pomponi et al. | 239/528 X |
| 4,934,603 | 6/1990 | Lasley | 239/528 X |
| 4,959,159 | 9/1990 | Mattson | 239/526 |
| 5,078,322 | 1/1992 | Torntore | 239/527 X |
| 5,183,207 | 2/1993 | Steinberg et al. | 239/526 |

FOREIGN PATENT DOCUMENTS

| | | |
|---|---|---|
| 447683 | 9/1991 | European Pat. Off. . |
| 2267154 | 11/1975 | France . |
| 3610629 | 10/1987 | Germany . |

*Primary Examiner*—Andres Kashnikow
*Assistant Examiner*—Kevin P. Weldon
*Attorney, Agent, or Firm*—MacMillan, Sobanski & Todd

[57] ABSTRACT

A seal assembly for providing multiple fluid tight seals about a valve needle or other axially moveable shaft, such as a valve needle in a spray gun. The seal assembly is disposed in a chamber through which the shaft passes. Two conical sealing surfaces are formed co-axially about the shaft at either end of the chamber. Two packing members are urged apart by a spring, each packing member being urged into a respective conical recess formed by one of the sealing surfaces and the shaft. Each packing member seals against one of the sealing surfaces and against the outer periphery of the shaft. A packing member may be formed to provide multiple stage sealing by providing a collar which causes a second end on the packing member to seal with the shaft.

7 Claims, 2 Drawing Sheets

SEAL FOR SPRAY GUN

TECHNICAL FIELD

This invention relates in general to shaft sealing and in particular to an improved structure of a fluid seal assembly suitable for sealing reciprocated valve needles used in spray guns.

BACKGROUND ART

Various types of equipment require the use of seals about axially moving parts of the equipment to prevent the flow of fluids from one or more locations into an undesired location. One instance of this is in the spray painting industry. Spray guns typically combine liquid paint and compressed air to form a stream of paint droplets directed toward a surface to be painted. Needle valves are typically utilized to control the flow of paint and air. Seals are installed about the valve stems or needles to prevent leakage of paints, air, and other fluids from the fluid conduits into the internal mechanisms of the spray gun. Leaking paint can eventually harden to prevent operation of the spray gun and can accelerate wear of gun components. These seals must be able to withstand wide ranges of pressure, and should have long service lives.

One type of commercial seal presently available is the chevron "V" packing seal. This packing material takes the shape of a chevron or "V" and can be made of any of a number of materials. Normally, this type of seal requires manual adjustment when first inserted into an annular void between the valve needle and the gun housing to pre-seat the packing. Pre-seating the packing involves the tightening of a gland nut to axially compress and radially expand the packing material, seating the packing material and initiating the seal. The gland nut is then loosened until the needle moves freely. Two obvious disadvantages with this type of seal are that pre-seating is required and that the adjustment of the packing material is dependent upon the operator's skill.

Another problem is maintaining a tight seal once the packing is installed. Existing "V" type packing seals often have some pockets or cavities spaced along the length of their inside diameters. As the packing material wears, the remaining packing material has to be further compressed by tightening the gland nut to maintain a tight seal. When the seal finally has to be replaced, the remaining packing material is tightly compressed deep within the annular void between the valve needle and the housing, making removal difficult.

Another type of seal is described in U.S. Pat. No. 4,406,468. This seal includes a packing member with a sharply cut-off tubular end. A stop member with a conical recess is positioned at an interior end of the void between the valve needle and the housing. Both the packing member and the stop member are coaxial with the valve needle. A spring is provided which forces the tubular end of the packing member into the conical recess of the stop member to form a fluid-tight seal. The sharp cut-off of the tubular end ensures that the compressive sealing forces occur at the front edge of the seal only, which reduces the amount of friction along the remainder of the packing. As the seal wears, the spring expands to force the packing member further into the conical recess to maintain a fluid tight seal. Thus, this seal is self-adjusting. The force which must be exerted by the spring in order to obtain a fluid tight seal is low, and the packing member does not need to be radially expanded. The replacement of worn seals is therefore easier than was known with existing "V" type packing seals.

Another advantage of this type of seal was it's improved service life compared to the "V" type packing seals. However, especially in the case where the fluid being sealed is a paint which includes abrasive materials, eventually abrasive particles impact themselves in the packing material and abrade grooves in the valve needle. The seal fails when a groove is formed of sufficient size to allow fluid to pass.

Additionally, it has been common practice to design the fluid (paint) seals for spray guns independently of the air seals, even when they sealed different portions of the same valve needle. Thus, air seals were provided in one portion of the spray gun, and that portion of the spray gun would have to be disassembled to service the air seals. Fluid seals were provided in a separate portion of the spray gun, which would have to be disassembled to service the fluid seals. It is often desirable to service the fluid and air seals during a single maintenance operation. In this case, two separate portions of the spray gun would have to be disassembled and reassembled.

Therefore it would be desirable to provide an improved structure for seal assemblies which lengthens the service life of the seal assembly, and which facilitates servicing of the seals.

DISCLOSURE OF INVENTION

The invention relates to an improved seal assembly for a sealing the periphery of a reciprocated cylindrical shaft at multiple locations. The seal assembly is particularly useful for forming seals between a reciprocated valve needle and both fluid and compressed air chambers in paint spray guns. The seal assembly is disposed within a chamber defined in a housing. The seal assembly includes first and second conical sealing surfaces in a chamber coaxial with the shaft, and first and second packing members disposed about a periphery of the shaft. The first packing member has a first end adapted to seal against the first sealing surface. The second packing member has a first end adapted to seal against the second sealing surface. A spring is provided which is compressed between the first and second packing members. The spring urges the first end of the first packing member against the conical first sealing surface. This causes the first end of the first packing member to seal against the shaft and the first sealing surface. The spring also urges the first end of the second packing member against the conical second sealing surface. This causes the first end of the second packing member to seal against the shaft and the second sealing surface.

One or both packing members may provide a multiple stage seal. In this case the packing member also includes an annular collar mounted coaxially with the shaft and engaging the first packing member. The spring is compressed against the collar. The collar is provided with an interior conical surface which the spring forces into engagement with a second end of the packing member. The first and second ends of the packing member are thereby simultaneously sealed against the periphery of the shaft.

Various objects and advantages of this invention will become apparent to those skilled in the art from the following detailed description of the preferred embodiment, when read in light of the accompanying drawings.

BEST MODE FOR CARRYING OUT THE INVENTION

Figure 1:
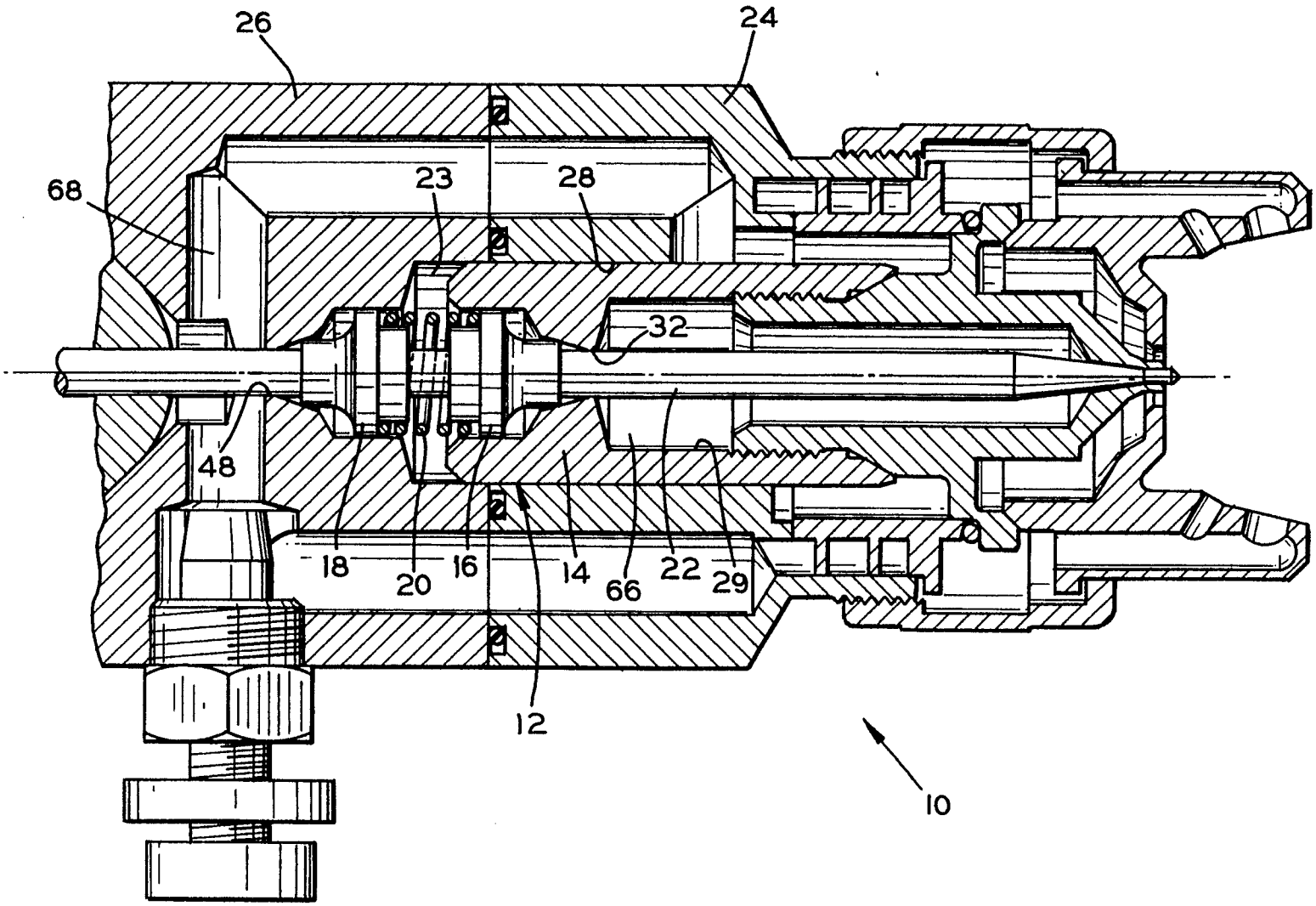
FIG. 1 is a fragmentary cross sectional view of a portion of a paint spray gun in which is positioned a seal assembly according to the present invention.

Referring now to the drawings, there is illustrated in FIG. 1 a fragmentary portion of a spray gun, indicated generally at 10, of a type known in the art which includes a seal assembly 12 of the present invention. The seal assembly 12 includes an insert 14, a first packing member 16, a second packing member 18, and a spring 20, all of which encircle a valve needle or shaft 22 of the spray gun 10. The seal assembly 12 is disposed in a chamber 23 defined within the housing of the spray gun 10. The spray gun 10 includes a head 24 and a body 26. The head 24 and the body 26 are fastened together by suitable means such as cap screws (not shown). The insert 14 is secured in a bore 28 in the head 24, for example, by means of a press fit.

Figure 2:
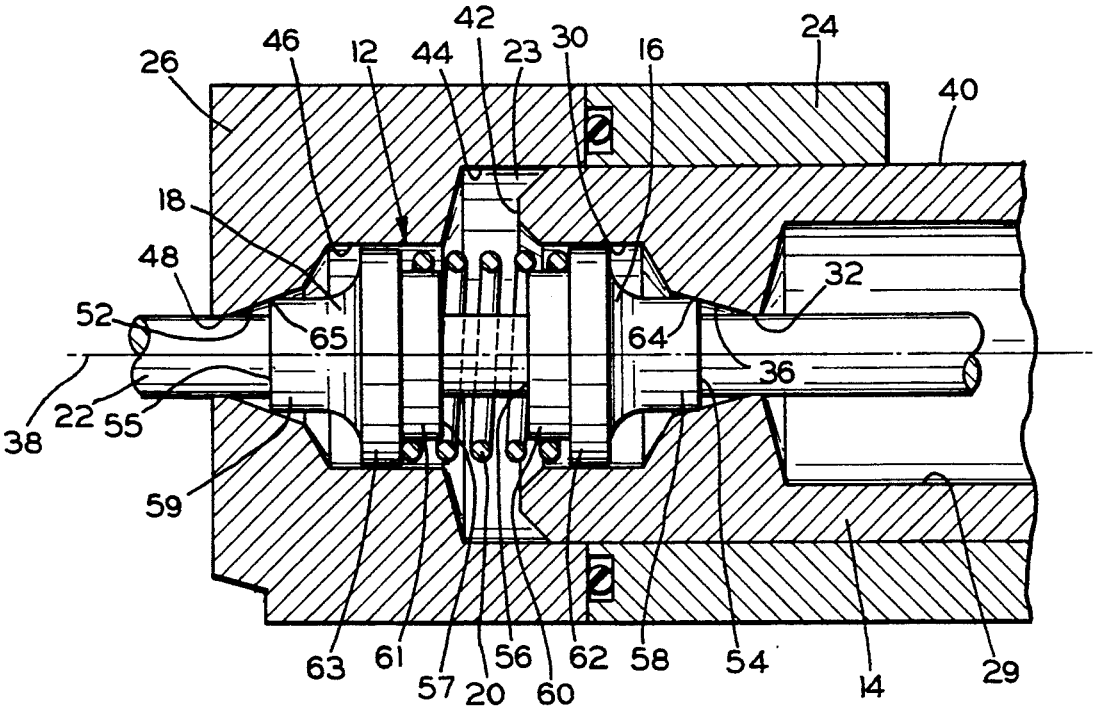
FIG. 2 is an enlarged fragmentary cross sectional view of a portion of FIG. 1.

As illustrated in FIG. 2, a bore 29 through the insert 14 includes a first portion 30 disposed about the first packing member 16, and a constricted second portion 32. The second portion 32 is slightly larger in diameter than the outside diameter of the shaft 22 to allow free movement of the shaft 22. A conical surface 36 opens from the second portion 32 towards the first portion 30. The conical surface 36 defines an acute angle to a longitudinal axis 38 of the seal assembly 12, and preferably defines an angle of about 7 or 8 degrees to the axis of the bore 29. As will be further described below, the conical surface 36 acts as a sealing surface when engaged by the first packing member 16. The insert 14 may suitably be formed of a material such as stainless steel.

The bore 28 aligns with a bore 44 in the body 26. Like the bore 28, the bore 44 is coaxial with the shaft 22. The bore 44 includes a first portion 46 and a constricted second portion 48, which preferably have the same dimensions as, respectively, the first portion 30 and second portion 32 of the bore through the insert 14. The second packing member 18 is disposed within the first portion 46. A conical surface 52 opens from the second portion 48 towards the first portion 46. The conical surface 52 defines an acute angle of up to 45 degrees to the axis 38 of the seal assembly 12, preferably at about 7 or 8 degrees. As will be further described below, the conical surface 52 acts as a sealing surface when engaged by the second packing member 18.

In the embodiment illustrated in FIGS. 1 and 2, the first packing member 16 and the second packing member 18 are of identical construction, though mounted facing opposite directions on the shaft 22. The packing member 16 has opposed first and second ends 54 and 56, respectively, and the packing number 18 has opposed first and second ends 55 and 57, respectively. The first ends 54 and 55 are perpendicular to the longitudinal axis 38 of the seal assembly 12. Each packing member 16 and 18 is provided with a bore (not shown) which is of a constant diameter just slightly larger than the outer diameter of the shaft 22. The packing members 16 and 18 are preferably made of a material having solvent resistance and exhibiting a low coefficient of friction, such as a tetrafluorinated resin (e.g. polytetrafluoroethylene (PTFE)).

The exterior of the packing member 16 has a first exterior portion 58 and a second exterior portion 60 and the exterior of the packing member 18 has a first exterior portion 59 and a second exterior portion 61. The first portions 58 and 59 are smaller in diameter than the second portions 60 and 61 and are designed to fit into the conical recess defined by the adjacent conical surface 36 or 52. The second portions 60 and 61 of the packing members 16 and 18 have outwardly extending circumferential flanges 62 and 63, respectively. The flanges 62 and 63 are spaced from the ends 56 and 57, respectively.

The spring 20 extends between the flange 62 of the first packing member 16 and the flange 63 of the second packing member 18. The spring 20 is disposed about the second portions 60 and 61 of the packing members 16 and 18, allowing the spring 20 to be coaxially positioned with the packing members 16 and 18.

The spring 20 is compressed between the flanges 62 and 63 and supplies the force necessary for effective sealing of both packing members 16 and 18. The spring 20 urges the first and second packing members 16 and 18 against the respective adjacent conical surfaces 36 and 52. As indicated above, the construction of the packing members 16 and 18 preferably is the same. Additionally, the dimensions of the bore second portions 32 and 48 are preferably identical. The manner in which the packing members 16 and 18 perform their sealing functions will therefore also be identical. Accordingly, only the manner in which the first packing member 16 will be described in detail.

As a result of the spring force acting against the flange 62 of the packing member 16, the first end 54 is urged against the conical surface 36. A sharp corner 64 on the packing member 16 contacts the conical surface 36. As the packing member 16 is urged against the conical surface 36, the resultant force vectors urge the first end 54 of the packing member 16 into fluid tight contact with the shaft 22. Thus the packing member 16 simultaneously seals against the conical surface 36 and the outer periphery of the shaft 22.

As the shaft 22 is reciprocated in the packing member 16 during use, the walls of the packing member 16 bore contacting the shaft 22 will eventually wear. As the packing member 16 wears, the first end 54 of the packing member 16 continues to advance along the conical surface 36, maintaining the seal against the conical surface 36 and the shaft 22. This results from the constant force being applied by the spring 20 against the flange 62 of the packing member 16.

As indicated above, under the urging of the spring 20 a sharp edge 65 on the second packing member 18 seals against the conical surface 52 and also forces the packing member 18 to seal against the shaft 22 in an manner identical to the manner in which the first packing member 16 seals. Thus, the seal assembly 12 is self-adjusting for wear, eliminating the need to periodically adjust the amount of compression on the packing. Additionally, the use of a spring 22 eliminates dependence upon the operator's skill for proper adjustment of the packing.

In the embodiment illustrated in FIGS. 1 and 2, the second portion 32 forms an aperture into a chamber 66 (FIG. 1) of the spray gun 10 which contains a fluid such as paint. The second portion 48 forms an aperture into a chamber 68 (FIG. 1) in which compressed air is present. As indicated above, the seal assembly 12 is disposed in a chamber 23 defined within the spray gun housing. To service the seal assembly 12, the head 24 need only be unfastened from the body 26. This provides access to both the fluid seal formed by the first packing member 16 and the first conical surface 36, and to the air seal formed by the second packing member 16 and the second conical surface 52. Advantageously, the spring 20 may be sized to form a friction fit with the radially outer surface of the second portions 60 of the first and second packing members 16 and 18. This allows the two packing members 16 and 18 and the spring 20 to be handled as a single replacement unit to facilitate removal of the packing members 16 and 18 from the respective bore portions 30 and 46 in which they are disposed. By making the packing members 16 and 18 identical in construction, the replacement unit comprising the packing members 16 and 18 and spring 20 need not be specially oriented prior to installing in the chamber 23.

Figure 3:
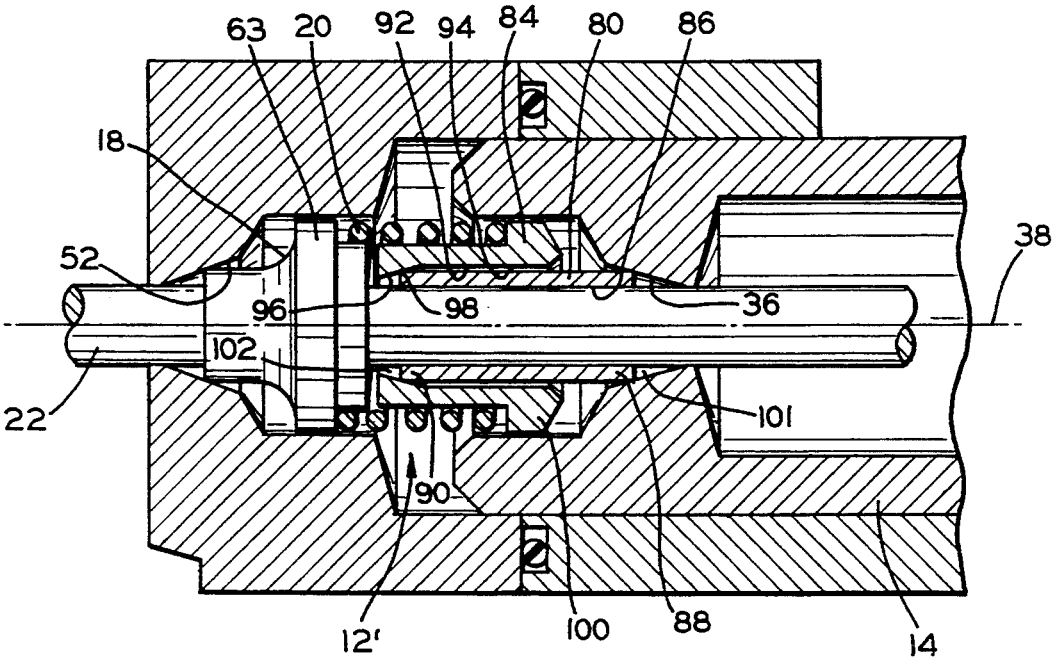
FIG. 3 is a fragmentary cross sectional view similar to that of FIG. 2 illustrating a modified seal assembly with a multiple stage seal according to the present invention.

FIG. 3 illustrates a modified embodiment of the present invention, in which a seal assembly 12' is installed in the same spray gun 10 illustrated in FIGS. 1 and 2. The seal assembly 12' is identical to the seal assembly 12, except that the first packing member 16, which is exposed to the paint or other coating fluid, is replaced with a first packing member 80 which provides multiple stage sealing. The first packing member 80 has a significantly increased operating life over the packing member 16 when exposed to abrasive fluids.

The first packing member 80 has a generally tubular shape and is partially surrounded by a collar 84. The first packing member 80 is disposed about the shaft 22, and has an axial bore 86 which is of a constant diameter just slightly larger than the outer diameter of the shaft 22. For reasons which will be discussed below, the length of the first packing member 80 should be more than two times the stroke length of the reciprocating shaft 22, and preferably about two and a half times the stroke length. The first packing member 80 has a first end 88 and a second end 90. The first end 88 is designed to engage the conical recess defined between the conical surface 36 and the shaft 22. The first packing member 80 is preferably made of a material having solvent resistance and exhibiting a low coefficient of friction, such as PTFE.

The collar 84 is preferably formed of a material which is relatively less deformable than the material of the first packing member 80, such as brass or stainless steel. The collar 84 has an axial bore 92. A first portion 94 of the bore 92 is disposed about the first packing member 80. A second portion 96 of the bore 92 is conically tapered and contacts the second end 90 of the first packing member 80.

A sharp edge 98 on the second end 90 engages the conical collar bore portion 96. The second portion 96 defines an acute angle of up to 45 degrees and preferably of about 7 or 8 degrees, to the axis 38 of the seal assembly 12' at the point of engagement by the edge 98.

The collar 84 also includes an outwardly extending flange 100. The spring 20 is compressed between the flange 100 and the second packing member flange 63, urging the second packing member 18 to seal in the manner described above. The force applied by the spring 20 is applied to the first packing member 80 through the edge 98. The first packing member 80 is urged into contact with the conical surface 36, where the resultant force vectors urge the first end 88 of the first packing member 80 into fluid tight contact with the shaft 22. Thus, the first packing member 80 simultaneously seals against the conical surface 36 and the outer periphery of the shaft 22, forming a first stage seal at 101.

The first packing member 80 is provided with a second stage seal 102 to the shaft 22 at the second end 90. When the first packing member 80 contacts the conical surface 36, the first packing member 80 resists the force applied through the edge 98. The resultant force vectors on the edge 98 urge the second end 90 of the first packing member 80 into fluid tight contact with the shaft 80 to form the second stage seal 102.

Tests have shown that in sealing against fluids containing abrasive particles, the multiple stage seal design described above has a significantly increased service life compared to a single stage seal. Initially only the first stage seal 101 is exposed to the abrasive particles in the fluid. As the bore at the first end 88 of the first packing member 80 wears, the force exerted by the spring 20 continues to urge the first packing member 80 to advance against the conical surface 36, maintaining the seal. Eventually, however, the first stage seal 101 will fail, and abrasive particles will enter the region between the first packing member 80 and the shaft 22.

As indicated above, the first packing member 80 is preferably at least twice the length of the stroke of the shaft 22. Abrasive particles on the shaft 22 adjacent the first stage seal 101 cannot therefore be directly transported to the second stage seal 102 when the shaft 22 is reciprocated. Instead, the fluid containing abrasive particles will have to be "pumped" along the shaft 22 until it reaches the second stage seal 102. The failed first stage seal 101 will continue to function partially by acting as a wiper for the second stage seal 102, thereby extending the life of the second stage seal 102.

It will be understood that the present invention may be practiced otherwise than as specifically explained and illustrated without departing from its spirit or scope. For example, while the present invention has been described as sealing a valve needle in a paint spray gun, it may be utilized in sealing various other types of shafts. Additionally, the bore 29 is described as being formed in the insert 14 which is inserted into the spray gun head 24. However, it will be appreciated that the spray gun head could be formed with an axial bore dimensionally similar to the bore 29. In such a spray gun head, no insert 14 would be required.

What is claimed is:

1. A seal assembly for sealing the periphery of a cylindrical shaft at multiple locations, said seal assembly and a portion of the shaft being disposed within a chamber defined in a housing, said seal assembly comprising:

a first conical sealing surface in the chamber coaxial with the shaft;

a tubular first packing member disposed about a periphery of the shaft and having a first end adapted to seal against said first sealing surface and having a second end;

a second conical sealing surface in the chamber coaxial with the shaft;

a second packing member disposed about the periphery of the shaft and having a first end adapted to seal against said second sealing surface;

an annular collar positioned coaxially on the shaft to move relative to said first packing member, said collar having an axial bore of a size to slide over a portion of said first packing member, said collar bore having an inwardly directed conical section which engages said second end of said first packing member, said collar having a radially outwardly extending flange; and a spring acting between said collar flange and second packing member, said spring urging said first end of said first packing member against said first sealing surface to cause said first end of said first packing member to seal against the shaft and said first sealing surface, said spring urging said conical collar bore section against said second end of said first packing member to cause said second end to seal against the shaft, said spring also urging said first end of said second packing member against said second sealing surface to cause said first end of said second packing member to seal against the shaft and said second sealing surface.

2. A multiple-stage seal for sealing the periphery of a cylindrical shaft comprising:

a tubular packing member disposed about a periphery of the shaft, said packing member having a cylindrical outer surface, a first end forming a first edge with said outer surface and a second end forming a second edge with said outer surface;

an annular collar defining an axial bore through which the shaft extends, said axial bore having a first portion disposed about said packing member, said axial bore having a radially constructed second portion positioned in contact with said second edge of said packing member;

a sealing surface positioned in contact with said first edge of said packing member;

means for urging said first end of said packing member into simultaneous sealing engagement with said sealing surface and the periphery of the shaft; and means for moving said collar relative to said packing member in a direction to urge said second end of said packing member into sealing engagement with the periphery of the shaft.

3. In a spray gun including a housing, a fluid chamber defined in said housing, an air chamber defined in said housing, and an axially moveable valve needle extending into said fluid chamber through a first aperture defined in said housing and into said air chamber through a second aperture defined in said housing, an improved seal assembly comprising a generally conical first sealing surface defined in said housing about said first aperture, a generally conical second sealing surface defined in said housing about said second aperture, a tubular first packing member disposed about said shaft adjacent said first aperture, said first packing member having a cylindrical outer surface, a first end forming a first edge with said outer surface and a second end forming a second edge with said outer surface, a second packing member disposed about said shaft adjacent said second aperture, a collar having a bore defining a first portion which extends coaxially over a portion of said first packing member and defining a conical portion which engages said second edge of said first packing member, wherein said collar is axially movable relative to said first packing member, and a spring compressed between said collar and said second packing member, said spring urging said second packing member to seal circumferentially against said valve needle and said second sealing surface, said spring urging said first edge of said first packing member to seal against said first sealing surface and urging said conical portion of said collar bore against said second edge of said first packing member to cause said first and second ends of said first packing member to each seal against said valve needle.

4. An improved seal assembly for a spray gun, as set forth in claim 3, wherein said first and second sealing surfaces and said conical portion of said collar bore each extend at an angle of about 7 to 8 degrees to the axis of said seal assembly.

5. For a spray gun including a housing, a fluid chamber defined in said housing, an air chamber defined in said housing, an axially moveable valve needle extending into said fluid chamber through a first aperture defined in said housing and into said air chamber through a second aperture defined in said housing, a generally conical first sealing surface defined in said housing about said first aperture, and a generally conical second sealing surface defined in said housing about said second aperture, a seal assembly comprising a tubular first packing member for positioning about the shaft adjacent the first aperture, said first packing member having first and second ends, wherein said first end engages said first sealing surface, a second packing member for positioning about the shaft adjacent the second aperture, a collar having a bore defining a first portion which extends coaxially over a portion of said first packing member and defines a conical portion which engages said second end of said first packing member, said collar being axially movable relative to said first packing member; and a spring compressed between said collar and said second packing member when said seal assembly is disposed in the housing, said spring urging said first end of said first packing member against the first sealing surface and urging said conical portion of said collar bore against said second end of said first packing member to cause said first and second ends of said first packing member to seal against the valve needle.

6. A seal assembly for use with a spray gun, as set forth in claim 5, and wherein said first and second sealing surfaces and said conical portion of said collar bore each extend at an angle of about 7 to 8 degrees to the axis of said seal assembly.

7. For a spray gun including a housing, a fluid chamber defined in said housing, an air chamber defined in said housing, an axially moveable valve needle extending into said fluid chamber through a first aperture defined in said housing and into said air chamber through a second aperture defined in said housing, a generally conical first sealing surface defined in said housing about said first aperture, and a generally conical second sealing surface defined in said housing about said second aperture, a seal assembly comprising a first packing member for positioning about the shaft adjacent the first aperture, a second packing member for positioning about the shaft adjacent the second aperture, a spring engaging said first and second packing members, said spring urging said first packing member to seal circumferentially against the valve needle and the first sealing surface and urging said second packing member to seal circumferentially against the valve needle and the second sealing surface when said seal assembly is disposed in the housing between the first and second sealing surfaces, wherein each of said first and second packing members includes a respective radially outer surface and said spring is sized to form a frictional fit with said radially outer surfaces of said first and second packing members, wherein each of said radially outer surfaces of said first and second packing members is provided with a radially outwardly extending flange, said spring acting between said flanges of said radially outer surfaces of said first and second packing members.

* * * * *